US011404019B2

(12) United States Patent
Qiu et al.

(10) Patent No.: US 11,404,019 B2
(45) Date of Patent: Aug. 2, 2022

(54) METHOD AND DEVICE FOR COMPENSATING COMMON VOLTAGE, AND DISPLAY DEVICE

(71) Applicants: Fuzhou BOE Optoelectronics Technology Co., Ltd., Fujian (CN); BOE TECHNOLOGY GROUP CO., LTD., Beijing (CN)

(72) Inventors: Xinmao Qiu, Beijing (CN); Zongxiang Li, Beijing (CN); Jiamin Liao, Beijing (CN); Jin Wang, Beijing (CN); Hao Cheng, Beijing (CN); Yao Liu, Beijing (CN); Min Zhou, Beijing (CN); Wenchang Tao, Beijing (CN); Zhendian Wu, Beijing (CN); Zuwen Liu, Beijing (CN); Guichun Hong, Beijing (CN); Zihua Zhuang, Beijing (CN); Yaochao Lv, Beijing (CN); Changhong Shi, Beijing (CN); Linlin Lin, Beijing (CN); Wen Zha, Beijing (CN); Jingguang Zhu, Beijing (CN); Jiantao Lin, Beijing (CN); Hongjiang Wu, Beijing (CN)

(73) Assignees: Fuzhou BOE Optoelectronics Technology Co., Ltd., Fuzhou (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/539,798

(22) Filed: Aug. 13, 2019

(65) Prior Publication Data

US 2020/0226998 A1 Jul. 16, 2020

(30) Foreign Application Priority Data

Jan. 14, 2019 (CN) ..... 201910031670.2

(51) Int. Cl.
*G09G 3/36* (2006.01)

(52) U.S. Cl.
CPC ... *G09G 3/3696* (2013.01); *G09G 2320/0209* (2013.01); *G09G 2320/0257* (2013.01)

(58) Field of Classification Search
None
See application file for complete search history.

(56) References Cited

U.S. PATENT DOCUMENTS 5,841,410 A * 11/1998 Oda ..... G09G 3/3648 345/94
2002/0021271 A1* 2/2002 Sakamoto ..... G09G 3/3622 345/87

(Continued)

*Primary Examiner* — Andre L Matthews
(74) *Attorney, Agent, or Firm* — Arch & Lake LLP

(57) ABSTRACT

The present disclosure provides a method for compensating a common voltage. The method for compensating a common voltage includes: generating a feedback signal by acquiring a real-time monitoring result of a feedback signal line on the common voltage, the feedback signal including a plurality of time periods, each of the time periods including a first sub-period in which the feedback signal is interfered by the periodic signal and a second sub-period in which the feedback signal is not interfered by the periodic signal; processing the feedback signal to eliminate distortion of the feedback signal caused by interference of the periodic signal in the first sub-period; and compensating for the common voltage according to the feedback signal.

4 Claims, 7 Drawing Sheets

(56) References Cited

U.S. PATENT DOCUMENTS

| | | | | |
|---|---|---|---|---|
| 2010/0066708 | A1* | 3/2010 | Kim | G09G 3/3614 345/204 |
| 2016/0188057 | A1* | 6/2016 | Liu | G06F 3/0446 345/174 |
| 2018/0090095 | A1* | 3/2018 | Jeon | G09G 3/3688 |
| 2019/0101776 | A1* | 4/2019 | Zhao | G09G 3/3677 |
| 2021/0043156 | A1* | 2/2021 | Dong | G09G 3/3655 |
| 2021/0065646 | A1* | 3/2021 | Lv | G09G 3/3696 |

* cited by examiner

METHOD AND DEVICE FOR COMPENSATING COMMON VOLTAGE, AND DISPLAY DEVICE

CROSS-REFERENCE

This application is based upon and claims priority to Chinese Patent Application No. 201910031670.2, filed on Jan. 14, 2019, the entire contents thereof are incorporated herein by reference.

TECHNICAL FIELD

The present disclosure relates to the field of display technologies, and more particularly, to a method and a device for compensating a common voltage, and a display device.

BACKGROUND

At present, liquid crystal displays (LCDs) are more and more widely used. The liquid crystal display utilizes a voltage difference between a common electrode and a pixel electrode to drive the liquid crystal molecules to rotate, thus realizing the image display. In the liquid crystal display, due to the presence of the coupling capacitance between the common electrode and the data line, when the data signal provided by the data line changes, the voltage across the coupling capacitor abruptly changes, causing the common voltage of the common electrode to fluctuate, which is difficult to be maintained stable. It can further cause abnormal voltage difference between the common electrode and the pixel electrode. Thus, problems such as afterimage and crosstalk on the liquid crystal display can arise, which affects the display effect. Therefore, it is necessary to compensate for the common voltage.

To compensate the common voltage, a feedback signal line is usually utilized to monitor and feed the actual fluctuation of the common voltage back. Then the common voltage is compensated according to the feedback signal fed back by the feedback signal line. However, the conventional compensation for the common voltage has a problem of low accuracy, resulting in abnormalities such as horizontal stripes on the display screen.

SUMMARY

The present disclosure provides a method and a device for compensating a common voltage, and a display device.

A first aspect of the present disclosure provides a method for compensating a common voltage, which is applied to a display device. The method includes generating a feedback signal by acquiring a real-time monitoring result of a feedback signal line on a common voltage. The feedback signal includes a plurality of time periods. Each of the time periods includes a first sub-period in which the feedback signal is interfered by the periodic signal and a second sub-period in which the feedback signal is not interfered by the periodic signal. The method includes processing the feedback signal to eliminate distortion of the feedback signal caused by interference of the periodic signal in the first sub-period. The method includes compensating for the common voltage according to the feedback signal processed.

In some arrangements, processing the feedback signal to eliminate distortion of the feedback signal caused by interference of the periodic signal in the first sub-period includes: in the first sub-period, changing the feedback signal to 0; and in the second sub-period, keeping the feedback signal unchanged.

In some arrangements, the feedback signal includes n time periods, where n is a positive integer greater than 1. Processing the feedback signal to eliminate distortion of the feedback signal caused by interference of the periodic signal in the first sub-period includes: in the second sub-period of the j-th period, keeping the feedback signal unchanged, and recording the waveform of the feedback signal in the second sub-period, where $1 \leq j < n$; in the first sub-period of the (j+1)-th period, according to the recorded waveform of the second sub-period of the j-th period, fitting the waveform of the feedback signal in the first sub-period; and changing the feedback signal to the waveform signal obtained by the fitting.

In some arrangements, processing the feedback signal to eliminate distortion of the feedback signal caused by interference of the periodic signal in the first sub-period includes determining the first sub-time period and the second sub-time period according to a timing of the periodic signal.

In some arrangements, the method for compensating a common voltage further includes a block of setting a time length of the first sub-period before a terminal product leaves the factory. The block includes: measuring, for a plurality of time, a duration time length in which the periodic signal interferes the feedback signal to cause the feedback signal to be distorted each time; and calculating an average value of the plurality of duration time lengths measured, and setting the average value as the time length of the first sub-period.

In some arrangements, the time length of the first sub-period ranges from 0.5 μs to 2 μs.

In some arrangements, generating a feedback signal by acquiring a real-time monitoring result of a feedback signal line on a common voltage includes: acquiring a real-time monitoring result of a feedback signal line on a common voltage, the real-time monitoring result reflecting an actual value of the common voltage at each time point; and calculating a difference between the actual value of the common voltage at each time point and a reference value of the common voltage, and generating the feedback signal according to the calculated difference.

A second aspect of the present disclosure provides a device for compensating a common voltage, which is applied in a display device. The device for compensating the common voltage includes a signal generator coupled to a feedback signal line, and configured to generate a feedback signal by acquiring a real-time monitoring result of the feedback signal line on the common voltage from the feedback signal line. The feedback signal includes a plurality of time periods, each of the time periods including a first sub-period in which the feedback signal is interfered by the periodic signal and a second sub-period in which the feedback signal is not interfered by the periodic signal. The device for compensating the common voltage includes a signal processor coupled to the signal generator and configured to process the feedback signal generated by the signal generator to eliminate distortion of the feedback signal caused by the interference of the periodic signal in the first sub-period. The device for compensating the common voltage includes a common voltage compensator coupled to the signal processor and configured to compensate for the common voltage according to the feedback signal processed by the signal processor.

In some arrangements, the signal processor includes an input end, an output end, and a switch. The input end is coupled to the signal generator. The output end is coupled to the common voltage compensator. The switch is coupled between the input end and the output end, and the switch is also coupled to the periodic signal line. The switch is configured to receive the periodic signal of the periodic signal line, switch off the line between the input end and the output end in the first sub-period, and switch on the line between the input end and the output end in the second sub-period according to the timing of the periodic signal.

In some arrangements, the signal processor includes an input end, an output end, and a fitting unit. The input end is coupled to the signal generator. The output end is coupled to the common voltage compensator. The fitting unit is coupled between the input end and the output end, and the fitting unit is also coupled to the periodic signal line. The fitting unit is configured to receive the periodic signal of the periodic signal line. According to the timing of the periodic signal, the fitting unit is configured to transmit the feedback signal from the input end to the output end in the second sub-period and record the waveform of the feedback signal in the second sub-period. In the first sub-period, the fitting unit is configured to fit the waveform of the feedback signal in the first sub-period according to the recorded waveform of the second sub-period adjacent to the first sub-period and before the first sub-period. The fitting unit is configured to transmit the waveform signal obtained by the fitting to the output end.

A third aspect of the present disclosure provides a display device including the device for compensating a common voltage provided in the second aspect.

BRIEF DESCRIPTION OF THE DRAWINGS

In order to more clearly illustrate the arrangement of the present disclosure or the technical solutions in the prior art, the drawings used in the arrangements or the description of the prior art will be briefly described below. Apparently, the drawings in the following description are only certain arrangements of the present disclosure, and other drawings can be obtained from these drawings by those skilled in the art without paying any creative work.

DETAILED DESCRIPTION

Arrangements of the present disclosure are described below with reference to the accompanying drawings. The described arrangements are only a part of the arrangements of the present disclosure, and not all of the arrangements. All other arrangements obtained by those skilled in the art based on the arrangements of the present disclosure without paying creative efforts are within the scope of the present disclosure.

Figure 1:
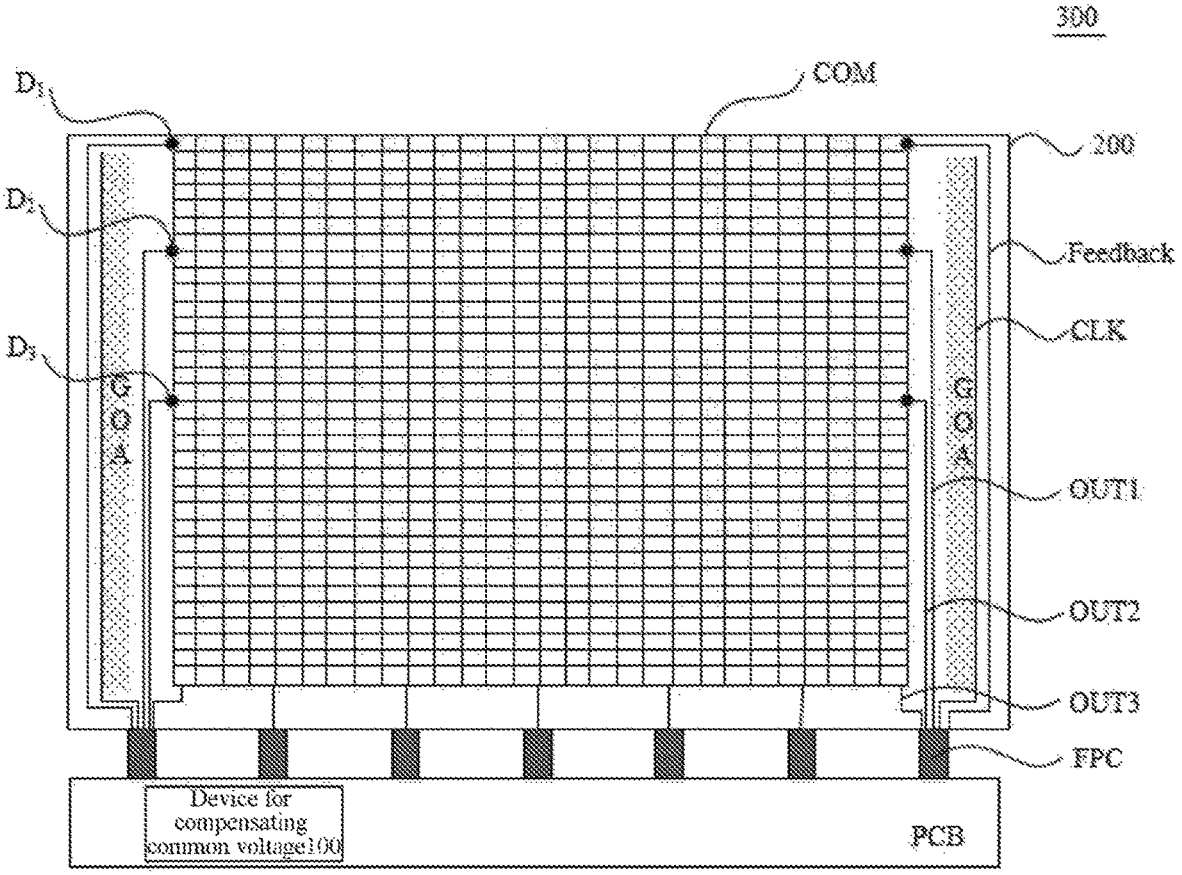
FIG. 1 is a system architecture diagram for compensating a common voltage in a display panel.
Figure 2:
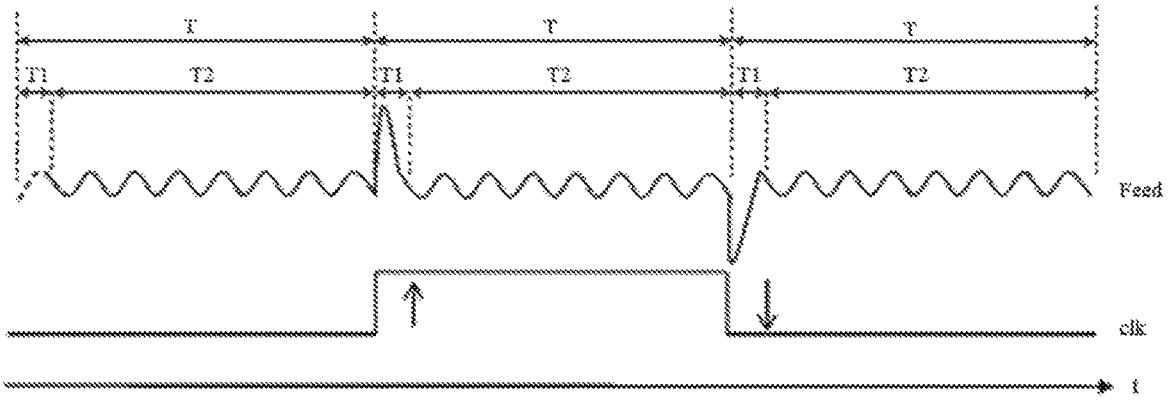
FIG. 2 is a schematic diagram of distortion of a feedback signal caused by periodic signal interference.

As shown in FIG. 1, FIG. 1 is a system architecture diagram for compensating a common voltage in a display panel 200 in a display device 300. A feedback signal line Feedback is coupled to a common electrode COM through a monitoring point $D_1$ to monitor the common voltage and output a feedback signal Feed, and the common voltage is compensated according to the feedback signal Feed. However, the existing display panel 200 is designed to use GOA (Gate Drive On Array) technology. In the GOA architecture, the periodic signal line CLK is parallel to the feedback signal line Feedback, and the feedback signal Feed is susceptible to the interference of the periodic signal clk transmitted in the periodic signal line CLK in the GOA architecture, and will be distorted, which is exhibited as a periodic distortion. As shown in FIG. 2, at each rising and falling edge of the periodic signal clk, the feedback signal Feed is interfered, resulting in corresponding upward or downward distortion. As a result, the feedback signal Feed is distorted, and is unable to feed back the true fluctuation of the common voltage.

In this case, if the common voltage is compensated according to the distorted feedback signal Feed, the voltage value subject to compensation may exceed the voltage value that is actually required to be compensated, and the accuracy of compensating the common voltage is low. Even worse, the compensated common voltage may occur abrupt change periodically, which makes the voltage difference between the common electrode and the pixel electrode have periodic abrupt change, thus causing a serious abnormality in the display image, such as periodic horizontal stripes.

Figure 3:
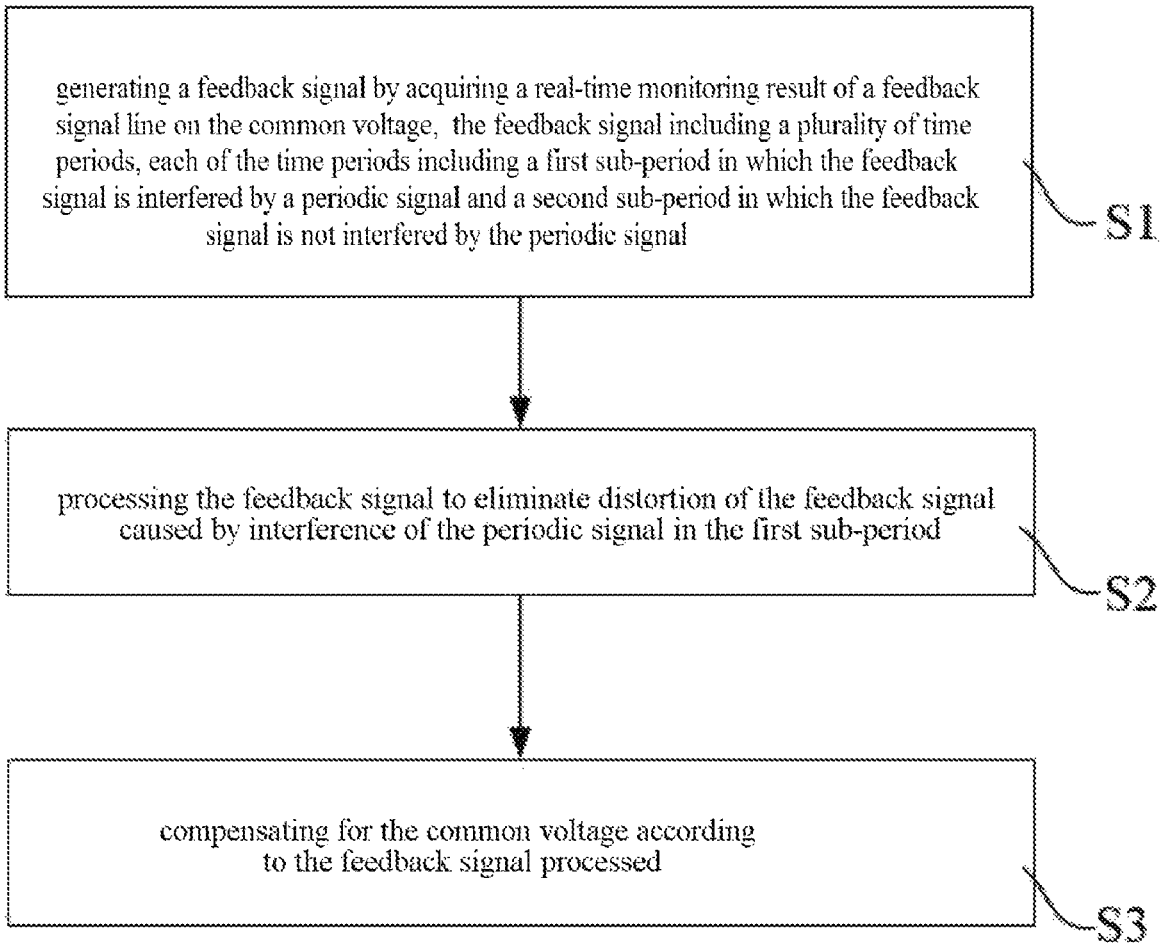
FIG. 3 is a first flowchart of a method for compensating a common voltage according to an arrangement of the present disclosure.

To solve the above problem, as shown in FIG. 3, an arrangement of the present disclosure provides a method for compensating a common voltage, including the following blocks.

In S1, a feedback signal Feed is generated by acquiring a real-time monitoring result of the feedback signal line Feedback on the common voltage.

In the above block S1, referring to FIG. 2, the feedback signal Feed interfered by the periodic signal clk transmitted in the periodic signal line CLK includes a plurality of time periods T, each of which includes a first sub-period $T_1$ in which the feedback signal Feed is interfered by the periodic signal clk and a second sub-period $T_2$ in which the feedback signal Feed is not interfered by the periodic signal clk.

Since the feedback signal Feed is affected by the periodic signal clk, the timing of the periodic signal clk includes a plurality of alternating low-level signals and high-level signals. One cycle includes a low-level period and a high-level period, and a low-level period or a high-level period of the periodic signal clk is one period T of the feedback signal Feed. When the level of the periodic signal clk is changed, that is, at the time when the periodic signal clk changes from a high level to a low level (i.e., a falling edge) or from a low level to a high level (i.e., a rising edge), the feedback signal Feed is subjected to corresponding downward or upward distortion due to the interference. The time at which the level of the periodic signal clk is changed is the start time of the first sub-period $T_1$ of each period T of the feedback signal Feed. From the start time to the time at which the waveform of the feedback signal returns to normal is the first sub-period $T_1$, and the remaining period in one period T other than the first sub-period $T_1$ is the second sub-period $T_2$.

In S2, the feedback signal Feed is processed to eliminate distortion of the feedback signal Feed caused by the interference of the periodic signal clk in the first sub-period $T_1$.

In S3, the common voltage is compensated according to the processed feedback signal Feed1.

In the method for compensating a common voltage provided by the arrangement of the present disclosure, before compensating the common voltage according to the feedback signal Feed, the block of processing the feedback signal Feed is added, to eliminate distortion of the feedback signal Feed caused by the interference of the periodic signal clk in the first sub-period $T_1$. It can avoid the influence of the distortion of the feedback signal Feed caused by the interference of the periodic signal clk on the common voltage compensation, so that the common voltage can be compensated according to the processed feedback signal Feed1, which can improve the accuracy of compensation of the common voltage, maintain the stability of the common voltage, and ensure that the display screen is displayed normally.

Moreover, the method for compensating a common voltage provided by the arrangement of the present disclosure does not need to change the conventional setting of the feedback signal line Feedback and the periodic signal line CLK in the existing display panel design while being capable of eliminating the distortion of the feedback signal Feed caused by the interference of the periodic signal clk. Therefore, the method can be applied to any display panel in which the feedback signal Feed is distorted by the periodic signal clk, which has high practicability and wide application range.

Figure 4:
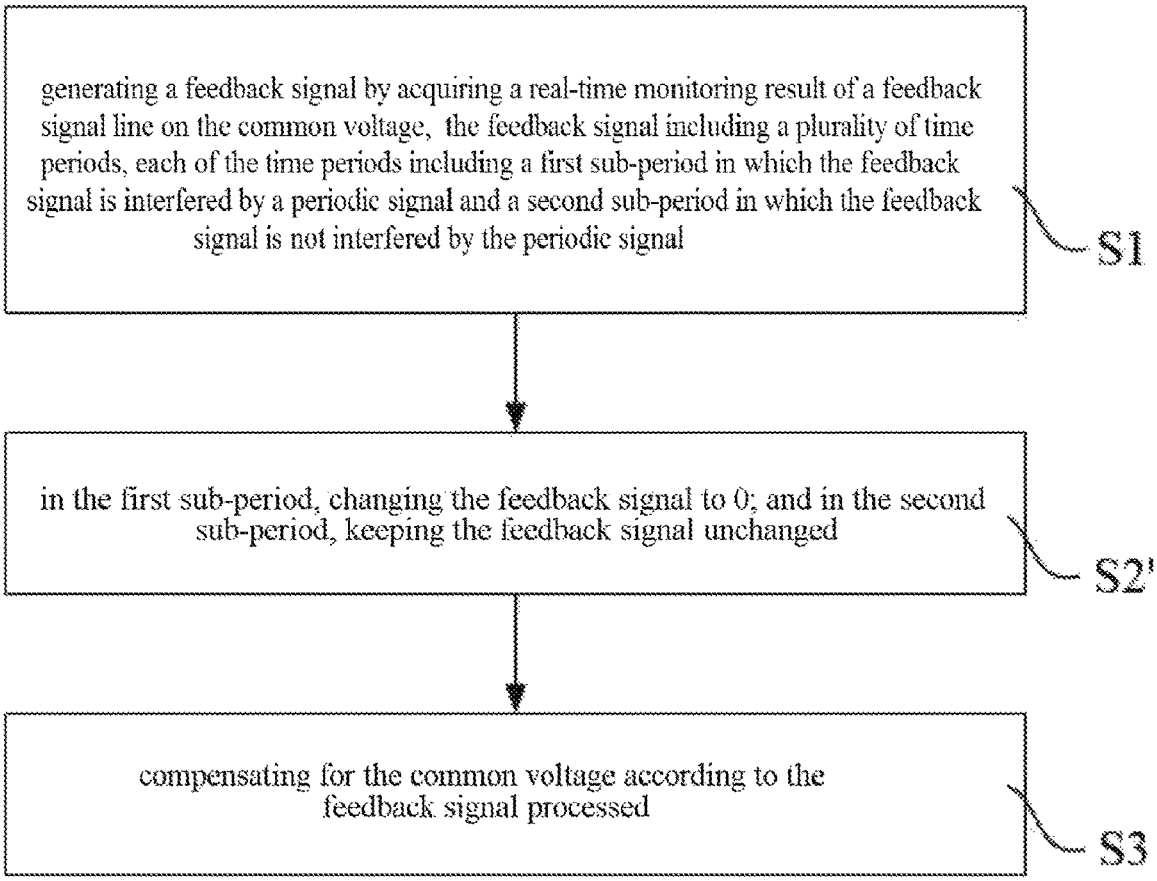
FIG. 4 is a second flowchart of a method for compensating a common voltage according to an arrangement of the present disclosure.

In some arrangements, as shown in FIG. 4, in the above block S2, the processing the feedback signal Feed to eliminate distortion of the feedback signal Feed caused by the interference of the periodic signal clk in the first sub-period $T_1$, includes the block S2': in the first sub-period $T_1$, changing the feedback signal Feed to 0; in the second sub-period $T_2$, keeping the feedback signal Feed unchanged.

Figure 5:
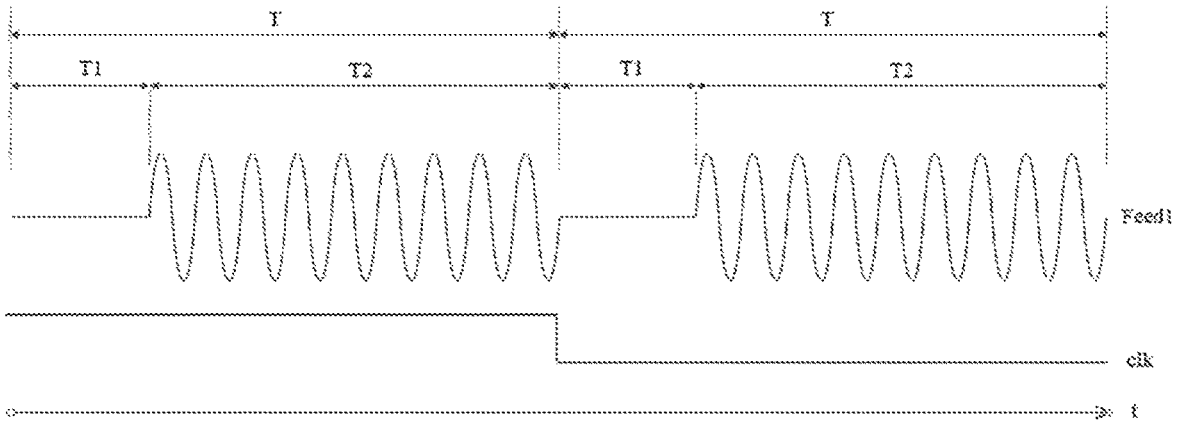
FIG. 5 is a first waveform diagram of a processed feedback signal in a method for compensating a common voltage according to an arrangement of the present disclosure.

Referring to FIG. 5, which is a waveform diagram of the processed feedback signal Feed1 obtained by the above scheme. In the first sub-period $T_1$, the feedback signal Feed becomes 0; and in the second sub-period $T_2$, the feedback signal Feed is not changed, and is output in a normal waveform.

The above scheme divides each period T of the feedback signal Feed into a first sub-period $T_1$ and a second sub-period $T_2$ and processes them separately. In the first sub-period $T_1$, the feedback signal Feed is distorted by the interference of the periodic signal clk, so it is processed to make the feedback signal Feed become 0, thus eliminating the distortion of the feedback signal Feed caused by the interference of the periodic signal clk in the first sub-period $T_1$. In the second sub-period $T_2$, the feedback signal Feed is not interfered by the periodic signal clk, and can reflect the true fluctuation of the common voltage, so the feedback signal Feed is not changed. The common voltage is compensated according to the processed feedback signal Feed1, that is, no compensation is performed in the first sub-period $T_1$, and normal compensation is performed in the second sub-period $T_2$. It can avoid the influence of the distortion of the feedback signal Feed caused by the interference of the periodic signal clk in the first sub-period $T_1$ on the common voltage compensation, which can maintain the stability of the common voltage, and ensure that the display screen is displayed normally.

It should be noted that since the feedback signal Feed is interfered on the rising edge and the falling edge of the periodic signal clk, generating corresponding distortions of rising and falling, so the first sub-period $T_1$ of each period T is very short, during which usually the fluctuation of the common voltage is relatively small. The common voltage is not compensated in such short period of time will not adversely affect the common voltage. That is, the common voltage can remain stable throughout the entire period, and the display screen can also be normally displayed.

Figure 6:
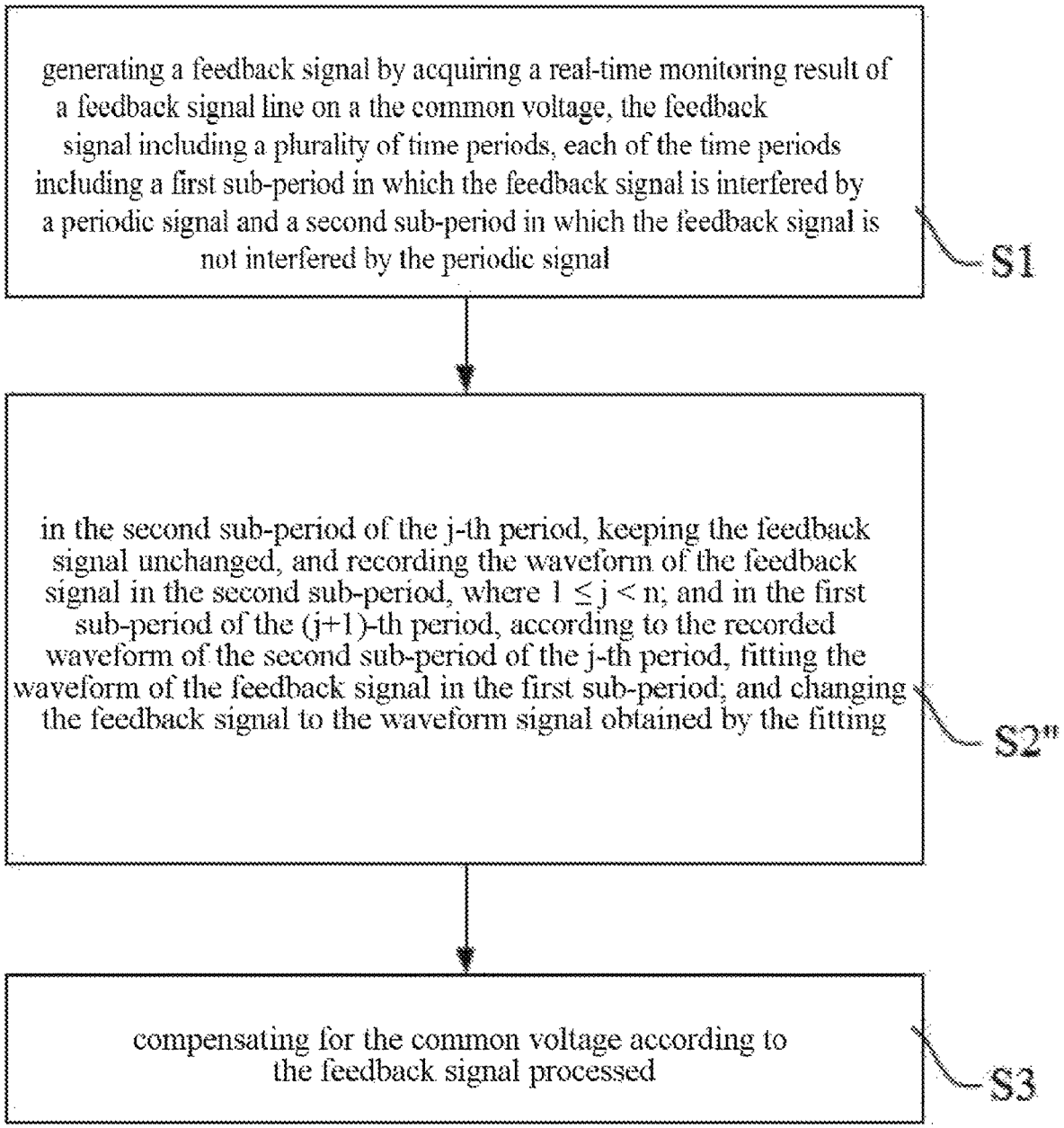
FIG. 6 is a third flowchart of a method for compensating a common voltage according to an arrangement of the present disclosure.

In some arrangements, the feedback signal Feed includes n time periods T, where n is a positive integer greater than 1. As shown in FIG. 6, the above block S2 of processing the feedback signal Feed to eliminate the distortion of the feedback signal Feed caused by the interference of the periodic signal clk in the first sub-period $T_1$ includes a block S2": in the second sub-period $T_2$ of the j-th period, keeping the feedback signal Feed unchanged, and recording the waveform of the feedback signal Feed in the second sub-period $T_2$, where $1 \leq j < n$; in the first sub-period $T_1$ of the (j+1)-th period, according to the recorded waveform of the second sub-period $T_2$ of the j-th period, fitting the waveform of the feedback signal Feed in the first sub-period $T_1$; and changing the feedback signal Feed to the waveform signal obtained by the fitting.

That is, in the second sub-period $T_2$, the feedback signal Feed is not changed, and the waveform of the feedback signal Feed in the second sub-period $T_2$ is recorded. In the first sub-period $T_1$, according to the recorded waveform of the second sub-period $T_2$ adjacent to the first sub-period $T_1$ and before the first sub-period $T_1$, the waveform of the feedback signal Feed in the first sub-period $T_1$ is fitted, and the feedback signal Feed is changed to the waveform signal obtained by the fitting.

For example, the specific fitting method is: setting a fitting function, fitting based on the recorded waveform of the second sub-period $T_2$ of the j-th period T, and fitting the waveform to a function of the voltage value of the feedback signal Feed over the time t, to obtain a specific formula of the fitting function; and according to the formula of the fitting function, at the first sub-period $T_1$ of the (j+1)-th time period T, obtaining the voltage value corresponding to each time point, that is, obtaining the waveform of the feedback signal Feed in the first sub-period $T_1$. For example, the fitting function can be a sine function, a cosine function, or any other function with a waveform close to the waveform of the feedback signal Feed.

Figure 7:
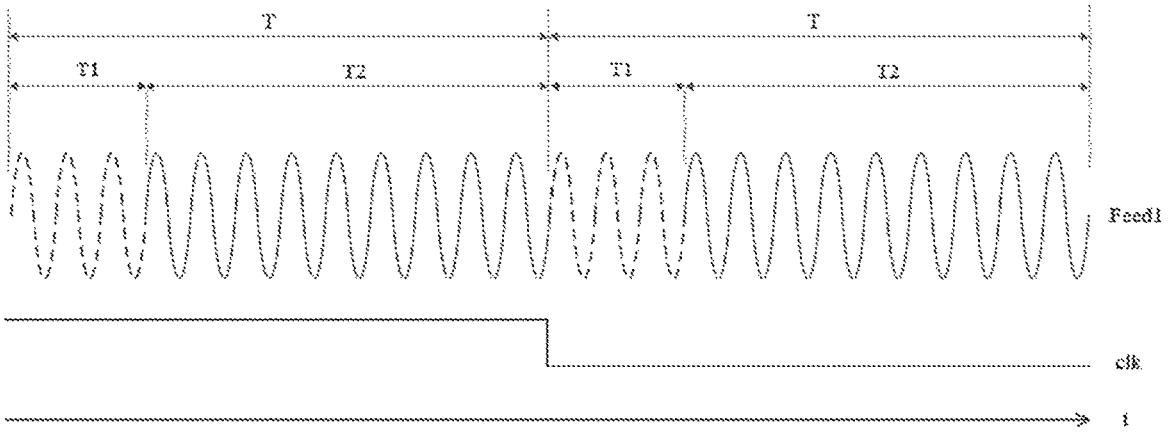
FIG. 7 is a second waveform diagram of a processed feedback signal in a method for compensating a common voltage according to an arrangement of the present disclosure.

Referring to FIG. 7, FIG. 7 is a waveform diagram of a processed feedback signal Feed1 resulted from the above solution, in which a solid line part of the figure represents the waveform of the feedback signal Feed in the second sub-period $T_2$ of the j-th period T, and the dotted line part indicates the waveform of the feedback signal Feed obtained from fitting in the first sub-period $T_1$ of the (j+1)-th time period T. It can be seen that the processed feedback signal Feed1 eliminates the distortion caused by the interference of the periodic signal clk and can reflect the true fluctuation of the common voltage.

The above scheme divides each period T of the feedback signal Feed into a first sub-period $T_1$ and a second sub-period $T_2$ and processes them separately. In the second sub-period $T_2$ of the j-th time period T, the feedback signal Feed is not interfered by the periodic signal clk, and does not need to be processed and changed. In the first sub-period $T_1$ of the (j+1)-th time period T, the waveform of the feedback signal Feed is fitted based on the second sub-period $T_2$ of the j-th time period T, to obtain the processed feedback signal Feed1. The processed feedback signal Feed1 eliminates the distortion of the feedback signal Feed caused by the interference of the periodic signal clk in the first sub-period $T_1$, and can reflect the fluctuation of the actual common voltage, so that the common voltage can be accurately compensated according to the processed feedback signal Feed1, which can significantly improve the accuracy of compensation of the common voltage, maintain the stability of the common voltage, and ensure that the display screen is displayed normally.

In some arrangements, when the feedback signal Feed is processed, the periodic signal clk is acquired, and the feedback signal Feed is controlled to be changed or not changed in a time divisional way according to the timing of the periodic signal clk.

Referring again to FIG. 2, since the feedback signal Feed is affected by the periodic signal clk, when the level of the periodic signal clk is changed, that is, at the time when the periodic signal clk changes from a high level to a low level or from a low level to a high level, the feedback signal Feed is subjected to corresponding upward or downward distortion due to the interference. The time at which the level of the periodic signal clk is changed is the start time of the first sub-period $T_1$ of each period T of the feedback signal Feed, and the first sub-period $T_1$ and the second sub-period $T_2$ can be determined according to the start time.

According to the timing of the periodic signal clk, the feedback signal Feed is controlled to be changed or unchanged, and the processing effect on the feedback signal Feed can be effectively ensured.

As a possible design, the method for compensating a common voltage further includes a block of setting time length of a first sub-period $T_1$ before the terminal product leaves the factory, and the block includes: measuring, for a plurality of times, a duration time length in which the periodic signal clk interferes the feedback signal Feed to cause the feedback signal Feed to be distorted each time, calculating an average value of the plurality of duration time lengths measured, and setting the average value as the time length of the first sub-period $T_1$.

By measuring, for a plurality of times, the duration time length in which the periodic signal clk interferes the feedback signal Feed to cause the feedback signal Feed to be distorted each time, and setting the average value of the duration time lengths as the time length of the first sub-period $T_1$, it can accurately obtain the time length in which the feedback signal Feed is interfered by the periodic signal clk, and can process it accordingly.

It should be noted that, since the feedback signal Feed that is distorted in the first sub-period $T_1$ is processed correspondingly, and the common voltage is compensated according to the processed feedback signal Feed1 finally output, the setting of the time length of the first sub-period $T_1$ will affect the actual effect of the common voltage compensation. The average value of the plurality of duration time lengths measured can be directly set as the time length of the first sub-period $T_1$, or it is possible to be based on the average value, set a value range around the average value as the range of the time length of the first sub-period $T_1$. The time length of the first sub-period $T_1$ may be any value within the value range of the first sub-period $T_1$ When the value of the time length of the first sub-period $T_1$ is set within the above-mentioned value range, if the accuracy of the common voltage compensation is more emphasized, the time length of the first sub-period $T_1$ may be set longer. Thus, according to the set time length of the first sub-period $T_1$, the feedback signal Feed can be processed to completely eliminate the distortion of the feedback signal Feed caused by the interference of the periodic signal clk, and further compensate the common voltage according to the final output processed feedback signal Feed1 with higher accuracy. If the speed of common voltage compensation is more emphasized, the time length of the first sub-period $T_1$ may be set shorter. Thus, according to the set time length of the first sub-period $T_1$, the feedback signal Feed can be processed. It can shorten the time length for processing the feedback signal Feed, and reduce the total time length required to compensate for the common voltage and thus increase the speed at which the common voltage is compensated. For example, the value range of the time length of the first sub-period $T_1$ is set to 0.5 μs to 2 μs. The time length of the first sub-period $T_1$ can be set to a value within the value range according to specific needs, to ensure the processing effect on the feedback signal Feed, thus ensuring the compensation effect on the common voltage.

Figure 8:
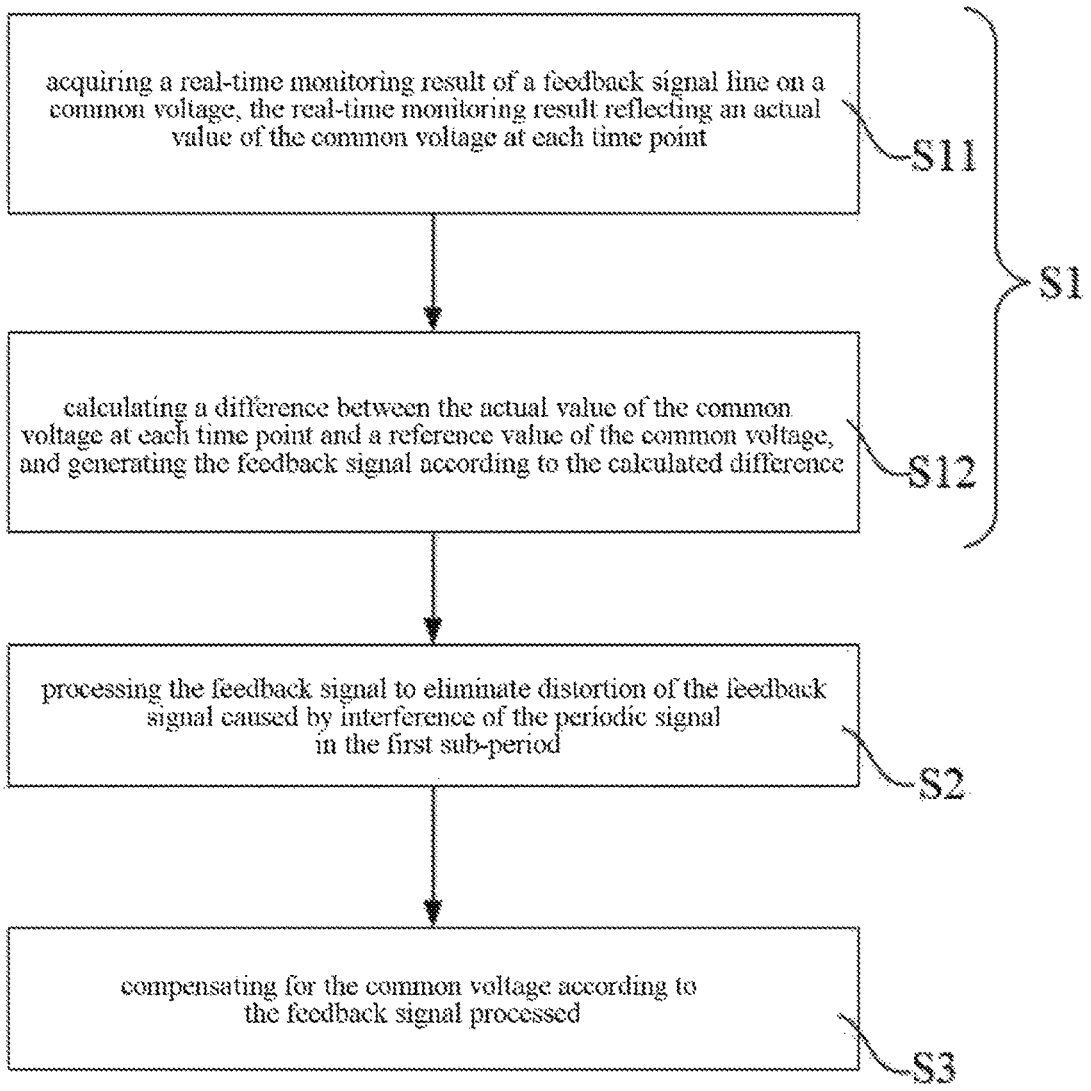
FIG. 8 is a fourth flowchart of a method for compensating a common voltage according to an arrangement of the present disclosure.

In some arrangements, as shown in FIG. 8, in block S1, the generating a feedback signal Feed by acquiring a real-time monitoring result of the feedback signal line Feedback on the common voltage includes the following blocks.

In S11, a real-time monitoring result of the feedback signal line Feedback on the common voltage is acquired, the real-time monitoring result reflecting an actual value of the common voltage at each time point.

In S12, a difference between the actual value of the common voltage at each time point and a reference value of the common voltage is calculated, and a feedback signal Feed is generated according to the calculated difference.

The above arrangement provides a specific manner of obtaining the feedback signal Feed. The voltage value of the feedback signal Feed is the difference between the actual value of the common voltage at each time point and a reference value of the common voltage.

In block S3, the compensating the common voltage according to the processed feedback signal Feed1, includes: generating a compensation amount according to the processed feedback signal Feed1, the polarity of the compensation amount being opposite to that of voltage of the processed feedback signal Feed1; and outputting the compensated common voltage obtained by summing the compensation amount and the reference value of the common voltage to the common electrode COM, to compensate the common voltage.

In some cases, since compensation common voltage signal may have delay or attenuation, when compensating for the common voltage, the compensation amount generated according to the processed feedback signal Feed1 is multiple times of the voltage value of the processed feedback signal Feed1, and the number of multiple times depends on the specific delay and attenuation of the compensation common voltage signal. Thus, the compensated common voltage obtained by summing the compensation amount and the reference value of the common voltage is output to the common electrode COM, and even if delay and attenuation occurs in the signal, the resulted common voltage will still be relatively stable.

Figure 9:
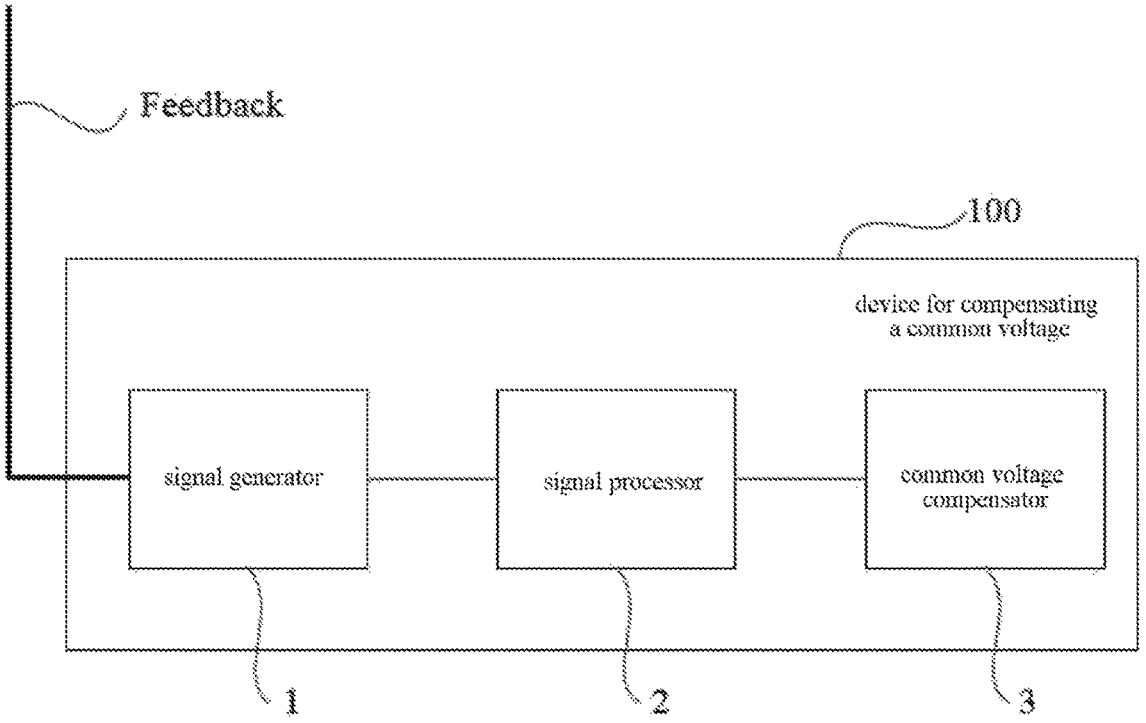
FIG. 9 is a first structural diagram of a device for compensating a common voltage according to an arrangement of the present disclosure.

An arrangement of the present disclosure further provides a device 100 for compensating a common voltage, which is applied to the display device 300. As shown in FIG. 9, the device 100 for compensating a common voltage includes a signal generator 1, a signal processor 2, and a common voltage compensator 3. The signal generator 1 is coupled to the feedback signal line Feedback, and is configured to generate a feedback signal Feed by acquiring a real-time monitoring result of the feedback signal line Feedback on the common voltage from the feedback signal line Feedback. The feedback signal Feed includes a plurality of time periods T, each of which includes a first sub-period $T_1$ in which the feedback signal Feed is interfered by the periodic signal clk and a second sub-period $T_2$ in which the feedback signal Feed is not interfered by the periodic signal clk. The signal processor 2 is coupled to the signal generator 1 and configured to process the feedback signal Feed generated by the signal generator 1 to eliminate distortion of the feedback signal Feed caused by the interference of the periodic signal clk in the first sub-period $T_1$. The common voltage compensator 3 is coupled to the signal processor 2 and is configured to compensate for the common voltage according to the feedback signal Feed1 processed by the signal processor 2.

In the above-mentioned device 100 for compensating a common voltage, the feedback signal Feed of the period in which the distortion occurs is processed by the signal processor 2. Thus, it can eliminate the distortion of the feedback signal Feed caused by the interference of the periodic signal clk in the first sub-period $T_1$. It can avoid the influence of the distortion of the feedback signal Feed caused by the interference of the periodic signal clk on the common voltage compensation, so that the common voltage can be compensated according to the processed feedback signal Feed1, which can improve the accuracy of compensation of the common voltage, maintain the stability of the common voltage, and ensure that the display screen is displayed normally.

Moreover, the device 100 for compensating a common voltage provided by the arrangement of the present disclosure is additionally provided with only the signal processor 1 for processing the feedback signal Feed compared with the conventional device for compensating a common voltage, thus realizing the effect of eliminating the distortion of the feedback signal Feed caused by the interference of the periodic signal clk in the first sub-period $T_1$. The device 100 for compensating a common voltage can be directly applied to any display panel to accurately compensate the common voltage without the need to change the conventional setting of the parallel feedback signal line Feedback and periodic signal line CLK in the existing display panel design, which has a high applicability.

Figure 10:
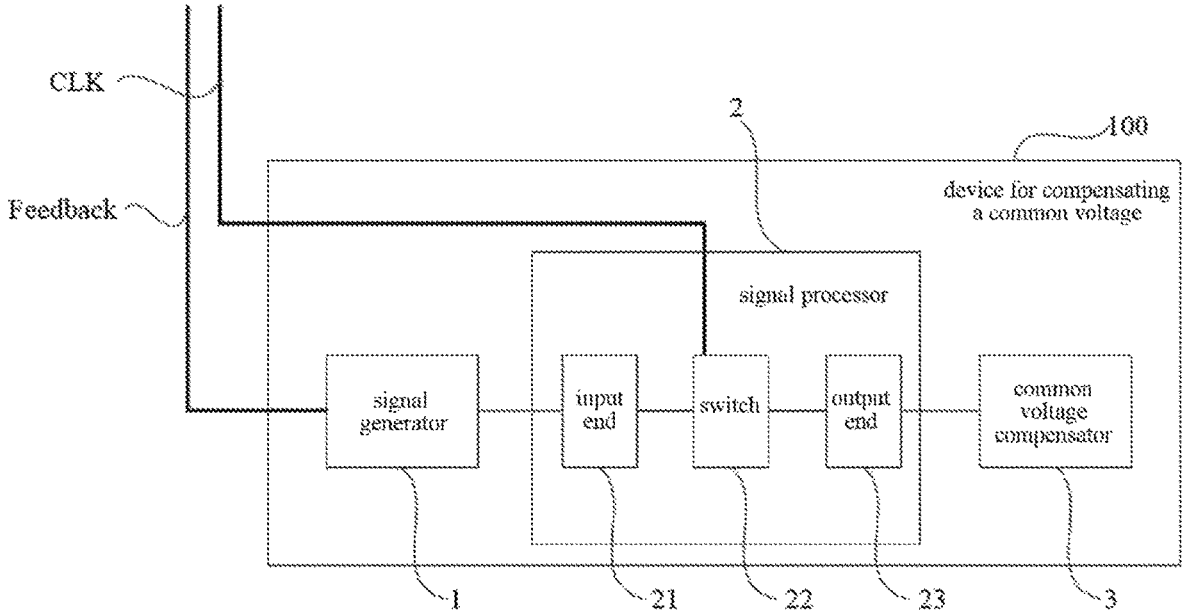
FIG. 10 is a second structural diagram of a device for compensating a common voltage according to an arrangement of the present disclosure.

In some arrangements, as shown in FIG. 10, the signal processor 2 includes an input end 21, an output end 23, and a switch 22. The input end 21 is coupled to the signal generator 1, and the output end 23 is coupled to the common voltage compensator 3. The switch 22 is coupled between the input end 21 and the output end 23, and the switch 22 is also coupled to the periodic signal line CLK. The switch 22 is configured to receive the periodic signal clk of the periodic signal line CLK, switch off the line between the input end 21 and the output end 23 in the first sub-period $T_1$, and switch on the line between the input end 21 and the output end 23 in the second sub-period $T_2$ according to the timing of the periodic signal clk.

The above arrangement provides a specific structure of the signal processor 2. The input end 21 is configured to receive the feedback signal Feed, the output end 23 is configured to output the processed feedback signal Feed1, and the switch 22 is coupled between the input end 21 and the output ends 23, and is configured to, according to the timing of the periodic signal clk, switch off the line between the input end 21 and the output end 23 in the first sub-period $T_1$, that is, to make the feedback signal Feed become 0, to eliminate the distortion of the feedback signal Feed caused by the interference of the periodic signal clk in the first sub-period $T_1$, and switch on the line between the input end 21 and the output end 23 in the second sub-period $T_2$, that is, to output the feedback signal Feed normally. In this way, the common voltage is compensated according to the processed feedback signal Feed1, that is, the compensation is not performed in the first sub-period $T_1$, and the compensation is normally performed in the second sub-period $T_2$, which can improve the accuracy of compensation of the common voltage, maintain the stability of the common voltage, and ensure that the display screen is displayed normally.

Figure 11:
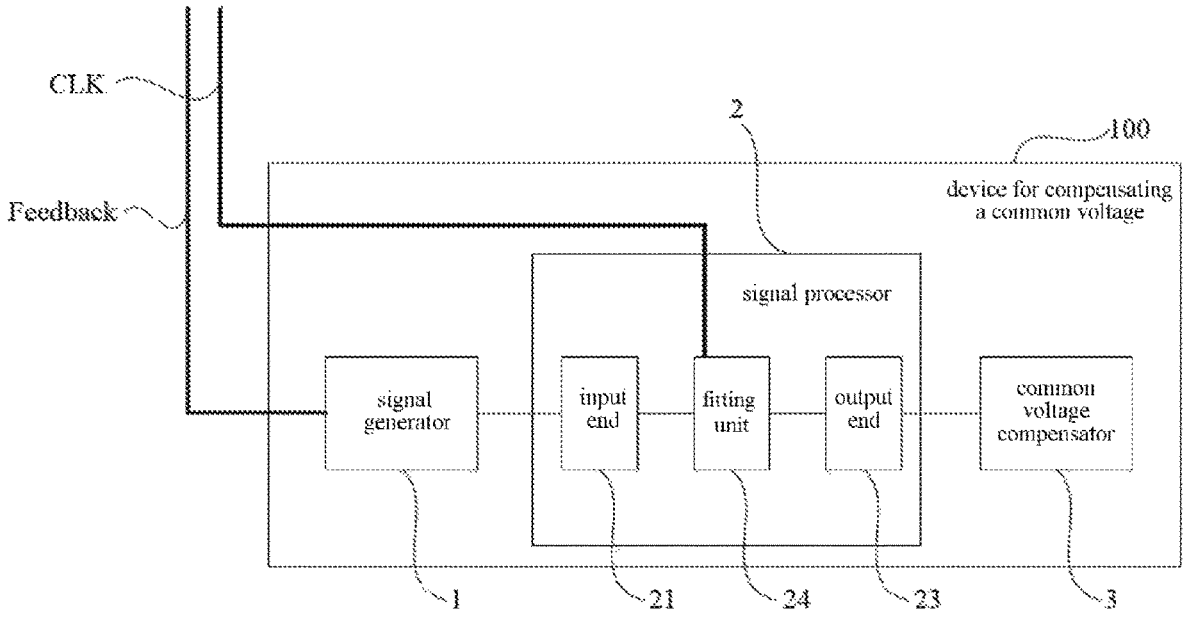
FIG. 11 is a third structural diagram of a device for compensating a common voltage according to an arrangement of the present disclosure.

In some arrangements, as shown in FIG. 11, the signal processor 2 includes an input end 21, an output end 23, and a fitting unit 24. The input end 21 is coupled to the signal generator 1, and the output end 23 is coupled to the common voltage compensator 3. The fitting unit 24 is coupled between the input end 21 and the output end 23. The fitting unit 24 is also coupled to the periodic signal line CLK. The fitting unit 24 is configured to receive the periodic signal clk of the periodic signal line CLK; according to the timing of the periodic signal clk, transmit the feedback signal Feed from the input end 21 to the output end 23 in the second sub-period $T_2$, record the waveform of the feedback signal Feed in the second sub-period $T_2$; in the first sub-period $T_1$, fit the waveform of the feedback signal Feed in the first sub-period $T_1$ according to the recorded waveform of the second sub-period $T_2$ adjacent to the first sub-period $T_1$ and before the first sub-period $T_1$; and transmit the waveform signal obtained by the fitting to the output end 23.

The above arrangement provides another specific structure of the signal processor 2. The input end 21 is configured to receive the feedback signal Feed, the output end 23 is configured to output the processed feedback signal Feed1, and the fitting unit 24 is coupled between the input end 21 and the output end 23, and configured to, according to the timing of the periodic signal clk, fit the waveform of the feedback signal Feed in the first sub-period $T_1$, and transmit the fitted waveform as the processed feedback signal Feed1 to the output end 23. The processed feedback signal Feed1 eliminates the distortion of the feedback signal Feed caused by the interference of the periodic signal clk in the first sub-period $T_1$, and can reflect the fluctuation of the actual common voltage. Therefore, it can improve the accuracy of compensation of the common voltage, maintain the stability of the common voltage, and ensure that the display screen is displayed normally.

Referring to FIG. 1 again, in some arrangements, the device 100 for compensating a common voltage is disposed on a PCB (Printed Circuit Board) board, and the PCB board is coupled to the display panel 200 through an FPC (Flexible Printed Circuit), thus realizing compensation of the common voltage by the device 100 for compensating a common voltage. Two first compensation voltage output lines OUT1 are symmetrically disposed respectively on each side of the display panel 200, and each of the first compensation voltage output lines OUT1 is coupled to the common electrode through a first compensation output point $D_2$ corresponding to the first compensation voltage output line OUT1. Two second compensation voltage output lines OUT2 are also symmetrically disposed respectively on each side of the display panel 200, and each of the second compensation voltage output lines OUT2 is coupled to the common electrode through a second compensation output point $D_3$ corresponding to the second compensation voltage output line OUT2. The ranges of the common electrodes corresponding to the first compensation output point $D_2$ and the second compensation output point $D_3$ are different, and the distance between the common electrode corresponding to the first compensation output point $D_2$ and the device 100 for compensating a common voltage is farther than the distance between the common electrode corresponding to the second compensation output point $D_3$ and the device 100 for compensating a common voltage. On a side of the display panel 200 near the PCB board, a plurality of common voltage output lines OUT3 coupled to the common electrodes COM are provided for transmitting the common voltage to the common electrodes COM In the compensation of the common voltage, in order to improve the delay or attenuation phenomenon of the compensation common voltage signal, the common voltage compensator 3 generates a compensation amount according to the processed feedback signal Feed1. The polarity of the compensation amount is opposite to that of voltage of the processed feedback signal Feed1, and the compensation amount is multiple times of the voltage value of the processed feedback signal Feed1. The compensated common voltage obtained by summing the compensation amount and the reference value of the common voltage is transmitted to the common electrode COM through the first compensation voltage output line OUT1 and the second compensation voltage output line OUT2, to compensate for the common voltage, and can maintain the output common voltage stable. For the common electrode COM near one side of the PCB board, the reference value of the common voltage is directly output, and is transmitted to the common electrode COM through the common voltage output line OUT3.

As a possible design, for the compensation of the common voltage, a corresponding compensation amount can also be generated according to the degree of delay or attenuation of the compensation common voltage signal. Since the common electrode COM corresponding to the first compensation output point $D_2$ is farther away from the device 100 for compensating a common voltage, the degree of delay or attenuation of the compensation common voltage signal may be higher, and therefore the compensation amount generated by the common voltage compensator 3 has a larger number of multiple times of the voltage value of the processed feedback signal Feed1, which may be, for example, 10 times. Since the common electrode COM corresponding to the second compensation output point $D_3$ is closer to the device 100 for compensating a common voltage, the degree of delay or attenuation of the compensation common voltage signal may be lower, and therefore the compensation amount generated by the common voltage compensator 3 has a smaller number of multiple times of the voltage value of the processed feedback signal Feed1, which may be, for example, 5 times. In this way, the compensated common voltage obtained by summing the compensation amount and the reference value of the common voltage is output to the common electrode COM. Even if a delay or attenuation occurs in the signal, the resulted common voltage will still be relatively stable.

It should be noted that the compensation voltage output line for transmitting the compensated common voltage to the common electrode COM may have other setting manners. For example, only one side of the display panel 200 is disposed with one or more compensation voltage output lines. The one or more compensation voltage output lines are coupled to the common electrodes COM through one or more compensation output points. Alternatively, one or more than two compensation output lines may be disposed on both sides of the display panel 200, and coupled to the common electrodes COM through corresponding compensation output points.

An arrangement of the present disclosure also provides a display device 300 including the device 100 for compensating a common voltage as provided above. The beneficial effects of the display device 300 are the same as those of the device 100 for compensating a common voltage, and are not described herein again.

In some arrangements, the device 100 for compensating a common voltage is mounted on a PCB board. The display device 300 further includes a display panel 200, to which the PCB board is bonded to implement electrical connection between the device 100 for compensating a common voltage and the display panel 200.

The above description is only the specific arrangements of the present disclosure, but the protection scope of the present disclosure is not limited thereto. Any change or replacement that can be easily conceived by those skilled in the art within the technical scope disclosed by the present disclosure should be covered by the protection scope of the present disclosure. Therefore, the protection scope of the present disclosure should be determined by the scope of the appended claims.

What is claimed is:

1. A method for compensating a common voltage, which is applied to a display device, the method comprising:

generating a feedback signal by acquiring a real-time monitoring result of a feedback signal line on the common voltage, wherein the feedback signal comprises a plurality of time periods, each of the time periods comprising a first sub-period in which the feedback signal is interfered by a periodic signal and a second sub-period in which the feedback signal is not interfered by the periodic signal;

processing the feedback signal to eliminate distortion of the feedback signal caused by interference of the periodic signal in the first sub-period; and compensating for the common voltage according to the feedback signal processed, wherein the feedback signal comprises n time periods, where n is a positive integer greater than 1; and wherein processing the feedback signal to eliminate distortion of the feedback signal caused by interference of the periodic signal in the first sub-period further comprises:

in the second sub-period of a j-th period, keeping the feedback signal unchanged, and recording a waveform of the feedback signal in the second sub-period, where 1 in the first sub-period of a (j+1)-th period, according to the waveform recorded in the second sub-period of the j-th period, fitting the waveform of the feedback signal in the first sub-period, and changing the feedback signal to the waveform obtained by the fitting:

wherein the waveform obtained by the fitting in the first sub-period of a (j+1)-th period and the waveform recorded in the second sub-period of the j-th period follow a same waveform function.

2. The method for compensating a common voltage according to claim 1, wherein processing the feedback signal to eliminate distortion of the feedback signal caused by interference of the periodic signal in the first sub-period comprises: determining a first sub-time period and a second sub-time period according to a timing of the periodic signal.

3. The method for compensating a common voltage according to claim 1, further comprising a block of setting a time length of the first sub-period, the block comprises:

measuring, for a plurality of times, a duration time length in which the periodic signal interferes the feedback signal to cause the feedback signal to be distorted each time; and calculating an average value of a plurality of duration time lengths measured, and setting the average value as the time length of the first sub-period.

4. The method for compensating a common voltage according to claim 1, wherein a time length of the first sub-period ranges from 0.5 μs to 2 μs.

* * * * *